US011509041B2

(12) United States Patent
Zhang et al.

(10) Patent No.: US 11,509,041 B2
(45) Date of Patent: Nov. 22, 2022

(54) ANTENNA OF MOBILE TERMINAL, AND MOBILE TERMINAL

(71) Applicant: ZTE Corporation, Shenzhen (CN)

(72) Inventors: Peng Zhang, Shenzhen (CN); Wei Hu, Shenzhen (CN); Feifei Zhang, Shenzhen (CN)

(73) Assignee: ZTE CORPORATION, Shenzhen (CN)

( * ) Notice: Subject to any disclaimer, the term of this patent is extended or adjusted under 35 U.S.C. 154(b) by 23 days.

(21) Appl. No.: 17/256,056

(22) PCT Filed: Apr. 24, 2019

(86) PCT No.: PCT/CN2019/084145
§ 371 (c)(1),
(2) Date: Dec. 24, 2020

(87) PCT Pub. No.: WO2020/001147
PCT Pub. Date: Jan. 2, 2020

(65) Prior Publication Data

US 2021/0226321 A1 Jul. 22, 2021

(30) Foreign Application Priority Data

Jun. 26, 2018 (CN) ..... 201810672340.7

(51) Int. Cl.
*H01Q 1/24* (2006.01)
*H01Q 1/48* (2006.01)
*H01Q 9/04* (2006.01)

(52) U.S. Cl.
CPC ..... *H01Q 1/243* (2013.01); *H01Q 1/48* (2013.01); *H01Q 9/0407* (2013.01)

(58) Field of Classification Search
CPC ..... H01Q 1/243; H01Q 1/48; H01Q 9/0407; H01Q 5/385; H01Q 9/42; H01Q 1/38;
(Continued)

(56) References Cited

U.S. PATENT DOCUMENTS

2007/0176827 A1 8/2007 Itoh
2010/0073254 A1 3/2010 Lee
(Continued)

FOREIGN PATENT DOCUMENTS

CN 1731623 A 2/2006
CN 101447602 A 6/2009
(Continued)

OTHER PUBLICATIONS

European Search Report for corresponding application EP19827121; Report dated Jun. 18, 2021.
(Continued)

*Primary Examiner* — Daniel D Chang
(74) *Attorney, Agent, or Firm* — Cantor Colburn LLP

(57) ABSTRACT

Provided are an antenna of a mobile terminal, and a mobile terminal. The antenna includes a dielectric substrate, a ground plate located on one side of the dielectric substrate, and a near-feed unit, a near-ground unit and a coupling unit that are arranged on the other side of the dielectric substrate; the near-ground unit has one end connected to the coupling unit and the other end connected to the ground plate; the coupling unit and the near-ground unit are equivalent to a Left-Handed (LH) inductor; the near-feed unit is equivalent to a Right-Handed (RH) inductor; the coupling unit is coupled to the near-feed unit and is equivalent to an LH capacitor; the coupling unit is coupled to the ground plate and is equivalent to an RH capacitor; and the near-feed unit, the near-ground unit, the coupling unit and the ground plate form a Composite Right-Left-Handed Transmission Line (CRLH-TL) structure.

18 Claims, 15 Drawing Sheets

(58) Field of Classification Search
CPC ..... H01Q 1/50; H01Q 5/378; H01Q 5/321; H01Q 9/0421; H01Q 9/0445
See application file for complete search history.

(56) References Cited

U.S. PATENT DOCUMENTS

| | | | | |
|---|---|---|---|---|
| 2011/0156963 | A1* | 6/2011 | Rajgopal ..... | H01Q 15/0086 343/702 |
| 2012/0001804 | A1 | 1/2012 | Pathak | |
| 2016/0093955 | A1 | 3/2016 | Ayala Vazquez | |
| 2016/0248146 | A1* | 8/2016 | Wang ..... | H01Q 9/0414 |
| 2017/0033460 | A1 | 2/2017 | Ayala Vazquez | |
| 2018/0048051 | A1 | 2/2018 | Chang | |

FOREIGN PATENT DOCUMENTS

| | | | |
|---|---|---|---|
| CN | 102110900 | A | 6/2011 |
| CN | 106299644 | A | 1/2017 |
| CN | 107359395 | A | 11/2017 |
| GB | 108593 | | 8/1917 |

OTHER PUBLICATIONS

International Serach Report ford corresponding application PCT/CN2019/084145 filed Apr. 24, 2019; dated Jun. 25, 2019.

* cited by examiner

ANTENNA OF MOBILE TERMINAL, AND MOBILE TERMINAL

CROSS-REFERENCE TO RELATED APPLICATION

The present application is based upon and claims priority to Chinese Patent Application No. 201810672340.7, filed on Jun. 26, 2018, the disclosure of which is hereby incorporated by reference in its entirety.

TECHNICAL FIELD

The present application relates, but is not limited, to the field of antennas, and more particularly to an antenna of a mobile terminal, and a mobile terminal.

BACKGROUND

Mobile communication systems undergo several generations of innovations with the development of the times, and have been developed from 1st-Generation (1G) and 2nd-Generation (2G) at the very beginning to 4th-Generation (4G) nowadays. Along with the development of the mobile communication systems, the design for antennas of mobile terminals is also developed so that the antennas can be adapted for actual requirements. At the present stage, the antennas of mobile terminals need to meet communication requirements of 2G, 3G and 4G, and are required to respectively cover multiple bands such as LTE700/GSM850/GSM900 DCS1800/PCS1900/UMTS/LTE2300/LTE2600. Hence, when designing the antennas of mobile terminals, considerations need to be given to the characteristics of multiple bands and broadband. In addition, in order to meet requirements of consumers on intelligence, while increasingly more functions are integrated on mobile terminals, spaces reserved for the antennas are smaller and smaller.

Presently, in design solutions for antennas of mobile phones, it is the most common way to use a Planar Inverted F-shaped Antenna (PIFA), a monopole antenna, an annular antenna, etc. The PIFA antenna has advantages such as small size, easiness in implementation, and good consistency in production. The monopole antenna is smaller in size and wider in bandwidth. However, the PIFA antenna has a narrow bandwidth, and the monopole antenna is susceptible to an ambient environment but it is very hard to keep an empty space over the ground for the antenna at the present stage.

SUMMARY

Embodiments of the present application provide an antenna of a mobile terminal, and a mobile terminal, so as to cover multiple bands while meeting requirements on the size of the antenna of the mobile terminal.

The embodiments of the present application provide an antenna of a mobile terminal, which may include a dielectric substrate and a ground plate located on one side of the dielectric substrate, and may further include: a near-feed unit, a near-ground unit and a coupling unit that are arranged on the other side of the dielectric substrate.

One end of the near-ground unit is connected to the coupling unit, and the other end of the near-ground unit is connected to the ground plate. The coupling unit and the near-ground unit are equivalent to a Left-Handed (LH) inductor. The near-feed unit is equivalent to a Right-Handed (RH) inductor. The coupling unit is coupled to the near-feed unit and is equivalent to an LH capacitor. The coupling unit is coupled to the ground plate and is equivalent to an RH capacitor. The near-feed unit, the near-ground unit, the coupling unit and the ground plate form a Composite Right-Left-Handed Transmission Line (CRLH-TL) structure.

The embodiments of the present application also provide a mobile terminal, which may include the above antenna of the mobile terminal.

The antenna of the mobile terminal designed on the basis of the CRLH-TL and provided in the embodiments of the present application can meet the requirements of mobile communication, is simple in structure and compact in layout, and can greatly save the antenna space.

Other features and advantages of the present application will be elaborated in the subsequent description; and some features and advantages may become apparent from the description, or may be understood by implementing the present application. The objectives and other advantages of the present application may be implemented and obtained from the structure particularly specified in the description, claims and accompanying drawings.

BRIEF DESCRIPTION OF THE DRAWINGS

The accompanying drawings are described here to provide a deeper understanding on the technical solutions of the present application, and form a part of the description. The accompanying drawings serve to explain the technical solutions of the present application with the embodiments of the present application, and do not form improper limits to the technical solutions of the present application.

DETAILED DESCRIPTION OF THE EMBODIMENTS

Figure 1:
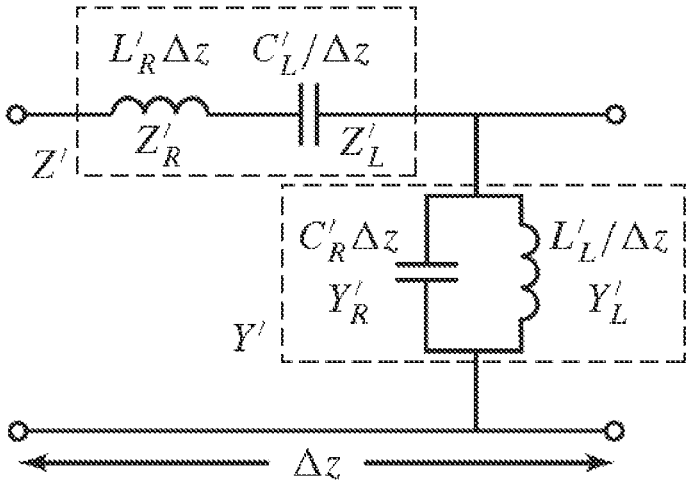
FIG. 1 is a schematic diagram of an ideal circuit model of a CRLH-TL.

In order to make the objectives, technical solutions and advantages of the present application clearer, the embodiments of the present application is described below in detail in combination with the accompanying drawings. It should be noted that embodiments in the present application and features in the embodiments may be combined under the condition of no conflicts.

The embodiments of the present application provide an antenna of a mobile terminal, which uses a CRLH-TL-based manner to cover multiple operation bands and adapt to the narrow and small space of the terminal in design.

Hereinafter, the descriptions are made for the principle of the CRLH-TL.

According to the Chu theorem, the maximum bandwidth supported by the electrically small antenna is directly proportional to the space occupied by the antenna. In order to acquire a large bandwidth, an enough space needs to be reserved for the electrically small antenna. The establishment of the Chu theorem is based on a Right-Handed (RH) rule of the electromagnetic wave, i.e., when the electromagnetic wave is propagated in most media in nature (with dielectric constant $\varepsilon>0$ and permeability $\mu>0$), the energy flow density of the electromagnetic field is $S=E*H$, where E is the intensity of electric field and H is the intensity of magnetic field. The direction of the poynting vector S is the propagation direction of the electromagnetic wave, i.e., a direction in which electromagnetic energy is transferred. The E, H and S are perpendicular to each other to form an RH spiral relationship.

The propagation of the electromagnetic wave in common media, i.e., RH materials, may also be analyzed with the Transmission Line (TL) theory. That is, the RL of the unit length may be equivalent to series distributed inductors and parallel distributed capacitors. The dispersion relationship (phase constant) is directly proportional to the frequency.

In a case of a material with $\varepsilon<0$ and $\mu<0$, when the electromagnetic wave is propagated therein, the intensity of electric field, intensity of magnetic field and poynting vector meet a Left-Handed (LH) spiral relationship, and there is no necessary constraint relationship between the resonance frequency and the physical size.

The LH materials may be equivalent to series distributed capacitors and parallel distributed inductors with a unit length, the phase propagation constant is negative and the phase velocity is reverse to the group velocity.

The LH materials practically used are all artificially manufactured with the RH materials in nature, so it is impossible to obtain a pure LH-TL. Therefore, both the LH material and the RH material exist in the TL, i.e., the transmission line is the CRLH-TL.

The CRLH-TL is provided with an LH mode and a Right-Left-Handed (RLH) mode. When the propagation constant is a pure real number, the transmission line is in a transmission forbidden band. Such a situation is an unbalanced state of the CRLH-TL, in which the series resonance point is different from the parallel resonance point. If the series resonance is identical to the parallel resonance, a balanced state is achieved, and no stop band exists between the LH characteristic frequency region and the RH characteristic frequency region. In such a case, there is no necessary constraint relationship between the resonance frequency and the physical size, and the central resonance frequency of the zero-order resonance point can be changed provided that the equivalent capacitance and inductance are changed by the change of a physical structure. By using this principle, the miniaturization of the antenna may be realized.

As shown in FIG. 1, the ideal circuit model of the CRLH-TL is composed of four portion: (a) an RH inductor $L'_R$, (b) an RH capacitor $C'_R$, (c) an LH inductor $L'_L$ and (d) an LH inductor $C'_L$. The portions (a) and (d) form the series portion in the equivalent circuit, the portions (b) and (c) form the parallel portion in the equivalent circuit, the portions (a) and (c) form the inductor portion in the equivalent circuit, the portions (b) and (d) form the capacitor portion in the equivalent circuit, the portions (a) and (b) form the RH portion in the equivalent circuit, and the portions (b) and (d) form the LH portion in the equivalent circuit.

Figure 2:
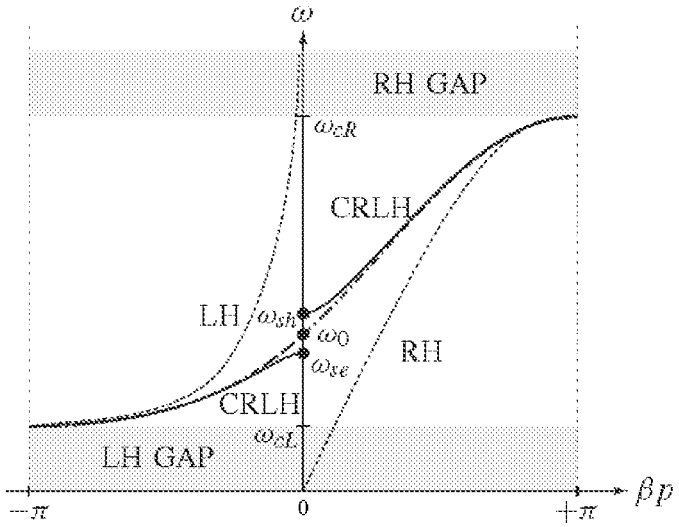
FIG. 2 is a schematic diagram of a dispersion relationship of a CRLH-TL.
Figure 3:
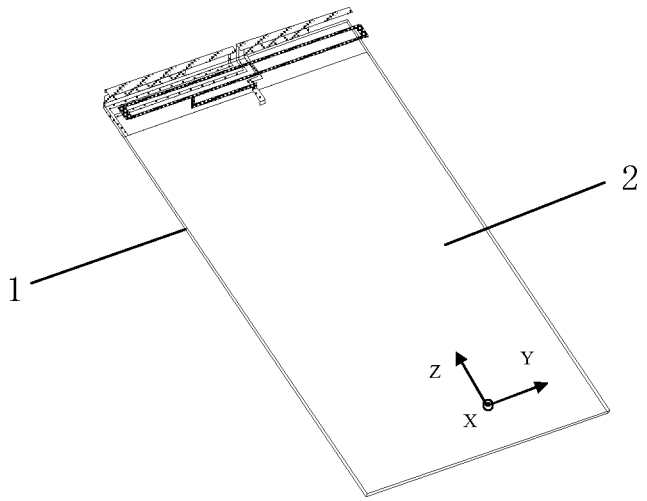
FIG. 3 is an overall structural schematic diagram of an antenna of a mobile terminal according to an embodiment of the present application.

In the CRLH-TL, the series resonance point may be represented by $\omega_{se}=1/\sqrt{L'_R C'_L}$, the parallel resonance point may be represented by $\omega_{sh}=1/\sqrt{L'_L C'_R}$, and the schematic diagram of the dispersion relationship is as shown in FIG. 2. Generally, the series resonance point and the parallel resonance point in the CRLH-TL are different, and such a situation is called the unbalanced state of the CRLH-TL, i.e., $\omega_{se}\neq\omega_{sh}$. When the CRLH-TL operates in the unbalanced state, the operation band between the $\omega_{se}$ and the $\omega_{sh}$ is manifested as the stop band. In order to obtain a better broadband characteristic, each electrical parameter in the equivalent circuit may be changed by adjusting physical structures corresponding to the LH capacitor and inductor and the RH capacitor and inductor, such that the CRLH-TL operates in the balanced state. When the CRLH-TL operates in the balanced state, and the series resonance is equal to the parallel resonance, $\omega_{se}=\omega_{sh}=\omega_0$, i.e., $L'_R C'_L=L'_L C'_R$. At this time, the CRLH-TL achieves the balance, and on the transition frequency $\omega_0$, the phase constant $\beta=0$. However, as the group velocity $v_g=d\omega/d\beta\neq0$, the wave is still propagated, and the CRLH-TL has no stop band.

For the purpose of utilizing the broadband characteristic of the CRLH-TL in the balanced state, the embodiments of the present application realize the CRLH-TL structure by means of the physical structure of the antenna, thereby meeting the broadband requirement of the antenna of the mobile terminal. Generally, the Inductor-Capacitor (LC) network is formed by distributive components such as a microstrip line, a strip line and a coplanar waveguide. For example, with the microstrip line for implementation, the LH inductor $L'_L$ mainly includes a spiral inductor and a short-circuited inductor, the LH capacitor $C'_L$ is implemented in the form of an interdigital capacitor, a slot capacitor and the like, and the RH capacitor and inductor are implemented by the microstrip line and a microstrip patch.

As shown in FIGS. 3-6, the antenna of the mobile terminal in the embodiment of the present application may include a dielectric substrate 1 and a ground plate 2 located on one side of the dielectric substrate, and may further include: a near-feed unit 7, a near-ground unit 5 and a coupling unit 11 that are arranged on the other side of the dielectric substrate. One end of the near-ground unit 5 is connected to the coupling unit 11, and the other end of the near-ground unit 5 is connected to the ground plate 2. The coupling unit 11 and the near-ground unit 5 are equivalent to an LH inductor. The near-feed unit 7 is equivalent to an RH inductor. The coupling unit 11 is coupled to the near-feed unit 7 and is equivalent to an LH capacitor. The coupling unit is coupled to the ground plate and is equivalent to an RH capacitor. The near-feed unit, the near-ground unit, the coupling unit and the ground plate form a CRLH-TL structure.

The antenna designed on the basis of the CRLH-TL in the embodiment of the present application can meet the requirements of mobile communication, is simple in structure and compact in layout, and can greatly save the antenna space.

Figure 4:
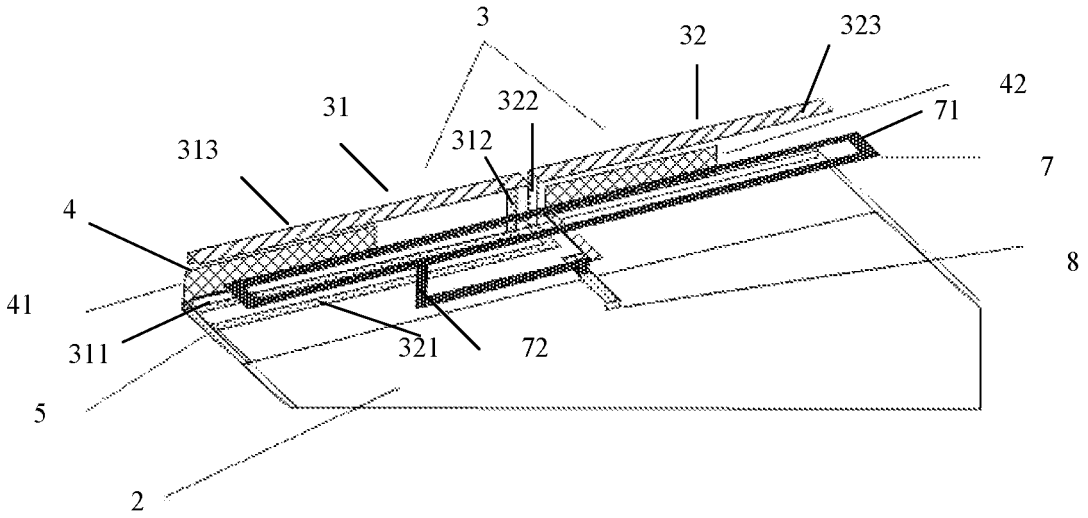
FIG. 4 is a structural schematic diagram of an antenna of a mobile terminal according to the embodiment in FIG. 3.
Figure 5:
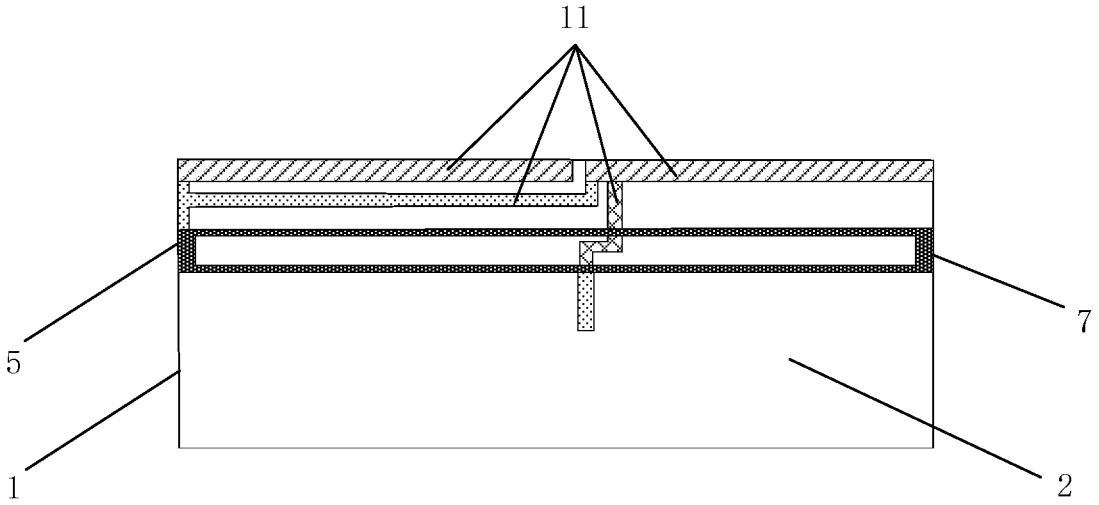
FIG. 5 is a top view of an antenna of a mobile terminal according to the embodiment in FIG. 4.
Figure 6:
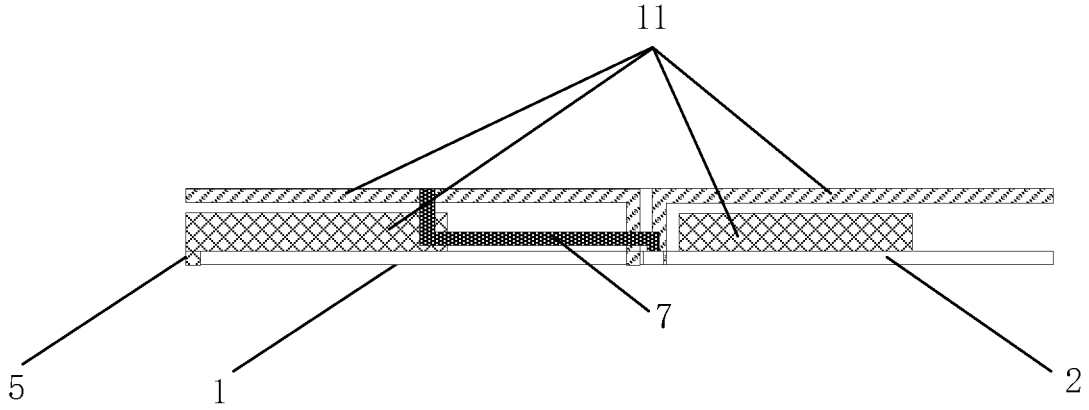
FIG. 6 is a side view of an antenna of a mobile terminal according to the embodiment in FIG. 4.

As shown in FIG. 4, the near-ground unit 5 is a short-circuited line. The near-feed unit 7 includes an annular portion 71 and a feed line 72 that are connected. One end of the feed line 72 is connected to the annular portion 71, and the other end of the feed line 72 is connected to a feed point 8.

The annular portion 71 is parallel to the dielectric substrate 1, and may be of a rectangular shape or an elliptical shape but is not limited thereto. The feed line 72 may be of an L-shaped structure or a linear structure but is not limited thereto.

In other embodiments, the near-feed unit 7 may also not use an annular structure but use a rectangular structure, an elliptical structure and the like.

In the embodiment of the present application, a gap is formed between the coupling unit 11 and the near-feed unit 7. By means of the gap, an LH capacitance effect is formed between the coupling unit 11 and the near-feed unit 7.

In other embodiments, the coupling unit 11 may also use an interdigital structure to form an LH capacitor.

The dielectric substrate 1 is disposed between the coupling unit 11 and the ground plate 2 to form an RH capacitance effect.

In the embodiment of the present application, the coupling unit 11 includes either or both of a low-frequency resonance unit 3 and a high-frequency resonance unit 4.

As shown in FIG. 4, the low-frequency resonance unit 3 includes a first branch 31 and a second branch 32. The first branch 31 is of a U-shaped structure. The second branch 32 is of a foldline structure. The first branch 31 is connected to the second branch 32 through the near-ground unit 5.

The first branch 31 may include a first segment 311, a second segment 312 and a third segment 313 that are sequentially connected. The first segment 311 is connected to the near-ground unit 5, and is located on a surface of the dielectric substrate 1. The second segment 312 is perpendicular to the dielectric substrate 1. The third segment 313 is away from the dielectric substrate 1, and is located above the first segment 311. A part of a plane of the third segment 313 is perpendicular to the dielectric substrate 1, and other part of the plane of the third segment 313 is parallel to the dielectric substrate 1.

The second branch 32 may include a fourth segment 321, a fifth segment 322 and a sixth segment 323 that are sequentially connected. The fourth segment 321 is connected to the near-ground unit 5, and is located on the surface of the dielectric substrate 1. The fifth segment 322 is perpendicular to the dielectric substrate 1. The sixth segment 323 is away from the dielectric substrate 1, and extends in a direction away from the fourth segment 321. A part of a plane of the sixth segment 323 is perpendicular to the dielectric substrate 1, and other part of the plane of the sixth segment 323 is parallel to the dielectric substrate 1.

As shown in FIG. 4, the high-frequency resonance unit 4 at least includes a first patch 41. The first patch 41 is perpendicular to the dielectric substrate 1.

The first patch 41 may be of a rectangular shape but is not limited thereto, and is located in a U-shape of a first branch 31 of the low-frequency resonance unit 3.

In an embodiment, the high-frequency resonance unit 4 may further include a second patch 42. The second patch 42 is perpendicular to the dielectric substrate 1.

The second patch 42 may be of a rectangular shape but is not limited thereto, and is located between the fifth segment 322 and the sixth segment 323 in the second branch of the low-frequency resonance unit 3 as well as the dielectric substrate 1.

The second patch 42 may be seen as a monopole patch. With the adoption of the second patch 42, the high-frequency resonance characteristic of the antenna may be improved, and the impedance bandwidth of the antenna is increased.

In the low-frequency operation situation, the low-frequency resonance unit 3 is coupled to the near-feed unit 7 by a series RH capacitor, and the near-feed unit 7 is equivalent to the series RH inductor, thereby forming the series capacitor and the series inductor of the CRLH-TL. By changing a distance between the low-frequency resonance unit 3 and the near-feed unit 7, the magnitude of the equivalent LH capacitor may be changed. Likewise, by changing the width and length of the near-feed unit 7, the magnitude of the corresponding RH inductor may be changed. Hence, the series resonance points of the antenna can be adjusted by changing the physical size of the antenna.

The low-frequency resonance unit 3 also has the RH capacitance over the ground, and forms the parallel capacitor and parallel inductor in the CRLH-TL together with the ground-near unit 5. Therefore, the integrated CRLH-TL circuit capable of operating in the low-frequency operation band is formed. The magnitude of the RH capacitor in the circuit may be changed correspondingly by changing the area of the low-frequency resonance unit 3. The magnitude of the LH inductor may be changed correspondingly by changing the dimensions of the short-circuited line 5 and/or the low-frequency resonance unit 3. Therefore, the corresponding parallel resonance points of the antenna can be changed by adjusting the physical dimensions of the antenna.

In the high-frequency operation situation, similar to the low-frequency situation, the high-frequency resonance unit 4 and the near-feed unit 7 form an LH capacitance effect, and the near-feed unit 7 is equivalent to the series RH inductor, thereby forming the series capacitor and the series inductor in the CRLH-TL circuit. The high-frequency resonance unit 4 also has the RH capacitance over the ground, and forms the parallel capacitor and the parallel inductor in the CRLH-TL circuit together with the near-ground unit 5. Therefore, the CRLH-TL circuit capable of operating in the high-frequency operation band is formed. The corresponding LH capacitance and RH inductance can be adjusted by changing the dimensions of the first patch 41 and/or the second patch 42 in the high-frequency resonance unit 4 and the dimensions of the near-feed unit 7, thereby adjusting the series resonance points of the corresponding equivalent circuit. The parallel resonance points may be changed by changing the dimensions of the first patch 41 and/or the second patch 42 in the high-frequency resonance unit 4 and the dimensions of the short-circuited line 5.

In the embodiment of the present application, the three-dimensional structure based on the CRLH-TL is used, and the traditional rectangular monopole structure is introduced to meet the requirements on wider bands. By virtue of the above solution, the antenna may respectively cover multiple low-frequency and high-frequency operation bands, and adapt to the situation of the narrow and small design space for the terminal.

In an embodiment of the present application, the overall structure of the antenna is as shown in FIGS. 3-6, with the dimensions of 65 mm*10 mm*5.8 mm. The ground plate of the antenna is similar to that of the conventional smartphone device. The dielectric substrate uses an FR4 substrate, with the dimensions of 65 mm*120 mm*0.8 mm. In the near-ground unit 5, the short-circuited line is 5-7 mm long and 0.5-2 mm wide. In the near-feed unit 7, the annular portion 71 may has an outer ring of 64 mm*4 mm and an inner ring of 63 mm*2.6 mm. In the low-frequency resonance unit 3, the first segment 311 and the third segment 313 in the first branch are 32-36 mm long and about 2 mm wide, and the second segment 312 is about 5 mm long and about 1 mm wide. In the second branch, the fourth segment 321 is 34-38 mm long, the fifth segment 322 is about 5 mm long and about 1 mm wide, and the sixth segment 323 is 28-32 mm long and about 2 mm wide. The gap between the first and second branches and the annular portion 71 is about 4 mm. In the high-frequency resonance unit 4, the first patch 41 may have the dimensions of 19.5 mm*3 mm, and the second patch 42 may have the dimensions of 17.5 mm*3 mm.

It is to be noted that the above is only exemplary dimensions of the antenna. In case of a change of the ground plate or the dielectric substrate, the antenna may operate normally only with appropriate adjustment on the antenna of the mobile terminal based on the CRLH-TL, that is, the antenna of the mobile terminal based on the CRLH-TL may have multiple types of dimensions, and may be combined with the ground plate of other dimensions and the dielectric substrate of different materials.

Figure 7:
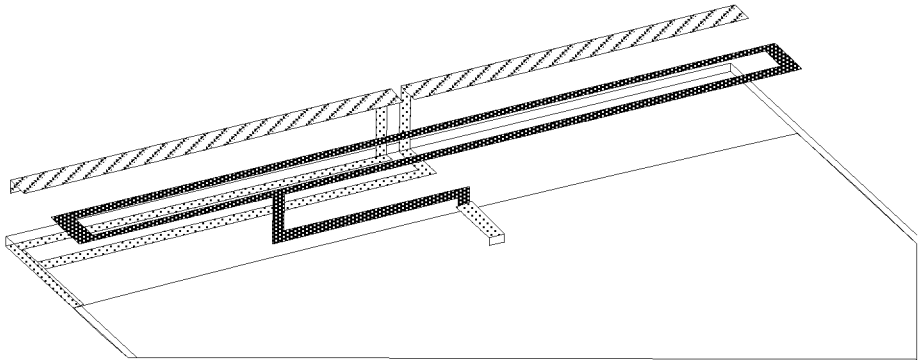
FIG. 7 is a structural schematic diagram of an antenna of a mobile terminal according to an embodiment of the present application (a high-frequency resonance unit is removed).

As shown in FIG. 7, in another embodiment of the present application, on the basis of the embodiment shown in FIGS. 3-6, the high-frequency resonance unit is removed, and a low-frequency antenna of the mobile terminal based on a CRLH structure is provided. The antenna may be applied to a mobile phone and other mobile terminals. The operation principle is identical to the low-frequency operation situation based on the embodiment shown in FIGS. 3-6.

Figure 8:
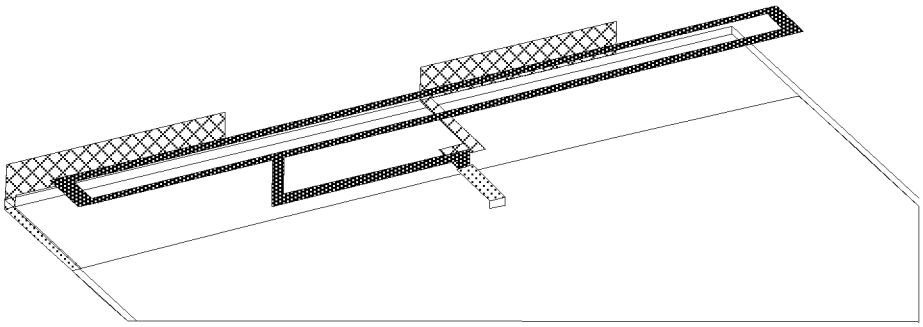
FIG. 8 is a structural schematic diagram of an antenna of a mobile terminal according to an embodiment of the present application (a low-frequency resonance unit is removed).

As shown in FIG. 8, in the embodiment, on the basis of the embodiment shown in FIGS. 3-6, the low-frequency resonance unit 3 is removed, and a high-frequency antenna of the mobile terminal based on a CRLH structure is provided. The antenna may be applied to a mobile phone and other mobile terminals. The operation principle is identical to the high-frequency operation situation based on the embodiment shown in FIGS. 3-6. Likewise, a segment of rectangular monopole structure (second patch 42) is added in the structure of the antenna to improve the resonance characteristic of the antenna and increase the impedance bandwidth.

Figure 9:
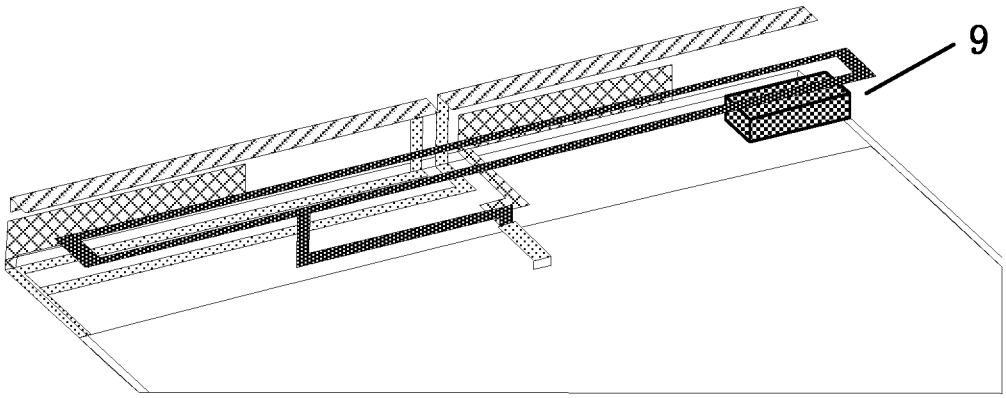
FIG. 9 is a structural schematic diagram of an antenna of a mobile terminal according to an embodiment of the present application (a metal component is added).

As shown in FIG. 9, on the basis of the embodiment shown in FIGS. 3-6, a metal component 9 that may be provided in actual applications is added under the antenna unit.

Figure 10:
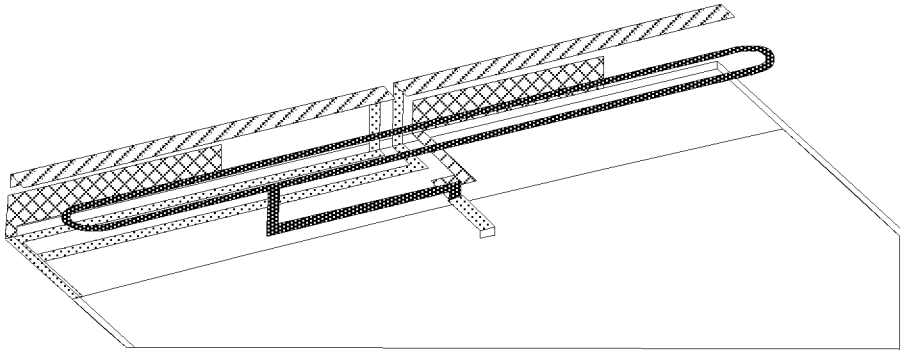
FIG. 10 is a structural schematic diagram of an antenna of a mobile terminal according to another embodiment of the present application (a rectangular ring in a near-feed unit is replaced with an elliptical ring).

FIG. 10 shows another implementation form of the antenna of the mobile terminal, with the operation principle similar to the embodiment shown in FIGS. 3-6. Herein, the rectangular ring in the near-feed unit is replaced with an elliptical ring.

Figure 11:
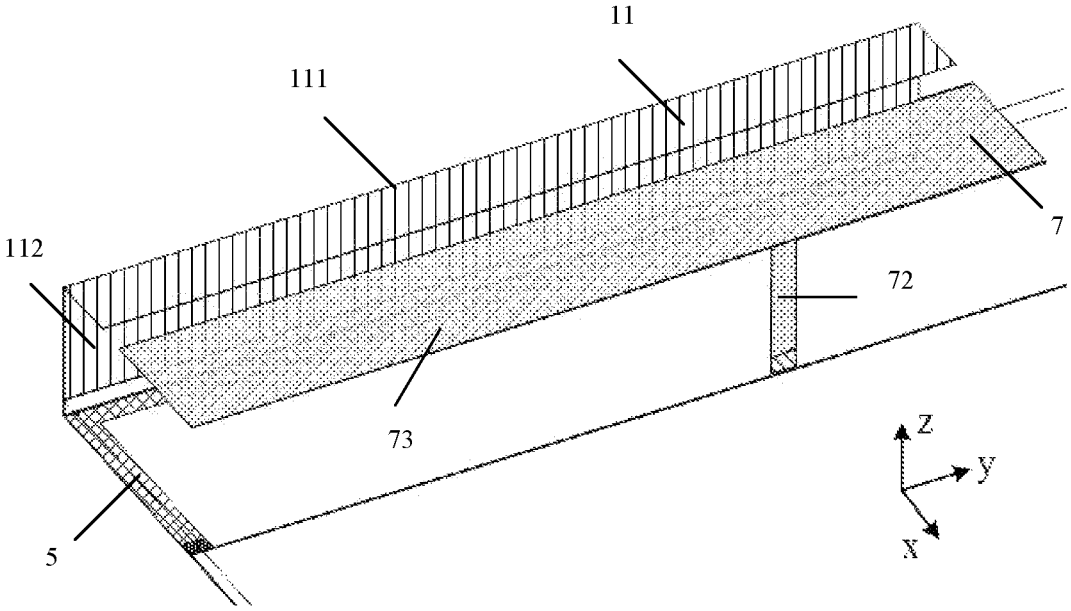
FIG. 11 is a structural schematic diagram of an antenna of a mobile terminal according to another embodiment of the present application (a shape is changed).

FIG. 11 shows another implementation form of the antenna of the mobile terminal, with a shape different from that shown in FIGS. 3-6, but the principle is the same as the principle explained above.

The coupling unit 11 is of an integral structure, and includes a first planar portion 111 and a second planar portion 112 that are connected. The first planar portion 111 is perpendicular to the dielectric substrate 1, and the second planar portion 112 is parallel to the dielectric substrate 1.

The near-ground unit 5 is a short-circuited line. The near-feed unit 7 includes a patch portion 73 and a feed line 72 that are connected. One end of the feed line 72 is connected to the patch portion 73, and the other end of the feed line 72 is connected to a feed point A gap is formed between the patch portion 73 and the second planar portion 112. By means of the gap, an LH capacitance effect is formed between the coupling unit 11 and the near-feed unit 7.

The patch portion 73 may be of a rectangular shape but is not limited thereto, is parallel to the dielectric substrate, and is located on the same plane with the second planar portion.

The embodiment in FIG. 11 uses a restructurable manner to implement a good operation state in the operation band.

Figure 12:
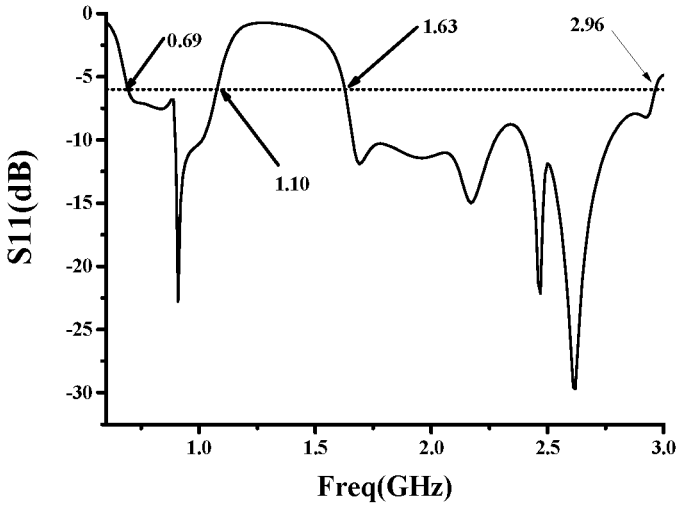
FIG. 12 is a schematic diagram for simulating calculation on an S parameter based on the embodiment shown in FIGS. 3-6.

Simulating calculation is performed for the S11 parameter based on the embodiment shown in FIGS. 3-6, the results are as shown in FIG. 12. With the S11 less than −6 dB as a standard, the impedance widths of the antenna based on the embodiment shown in FIGS. 3-6 are 680-1100 MHz and 1690-3000 MHz. It is indicated that the antenna can directly cover multiple bands such as LTE700, GSM850, GSM900, DCS1800, PCS1900, UMTS, LTE2300 and LTE2600, and has a wide operation band.

Figure 13:
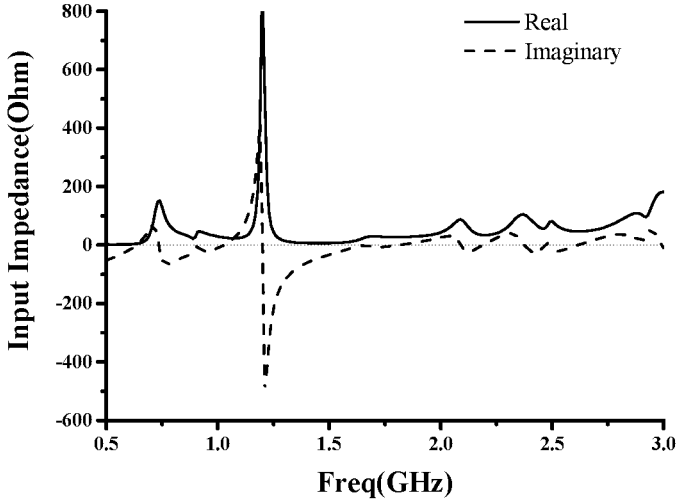
FIG. 13 is a schematic diagram for input impedance based on the embodiment shown in FIGS. 3-6.

Simulating calculation is performed for the input impedance parameter based on the embodiment shown in FIGS. 3-6, the results are as shown in FIG. 13. As can be seen from FIG. 13, the antenna has good resonance characteristic in low-frequency and high-frequency portions.

Figure 14:
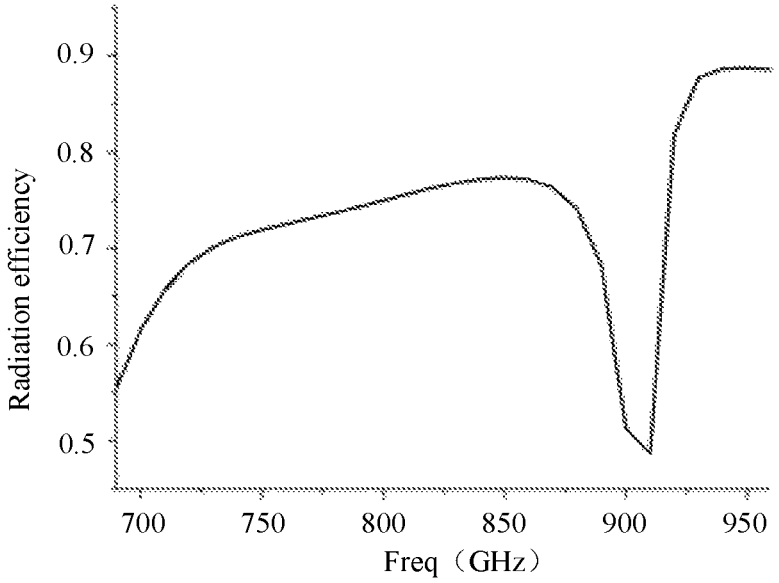
FIG. 14 is a schematic diagram for radiation efficiency of a low-frequency operation band (690-960 MHz) based on the embodiment shown in FIGS. 3-6.

Simulating calculation is performed for the radiation efficiency of the low-frequency band (690-960 MHz) based on the embodiment shown in FIGS. 3-6, the results are as shown in FIG. 14. It can be seen that the radiation efficiency of the antenna in the low-frequency band (690-960 MHz) is greater than 48%.

Figure 15:
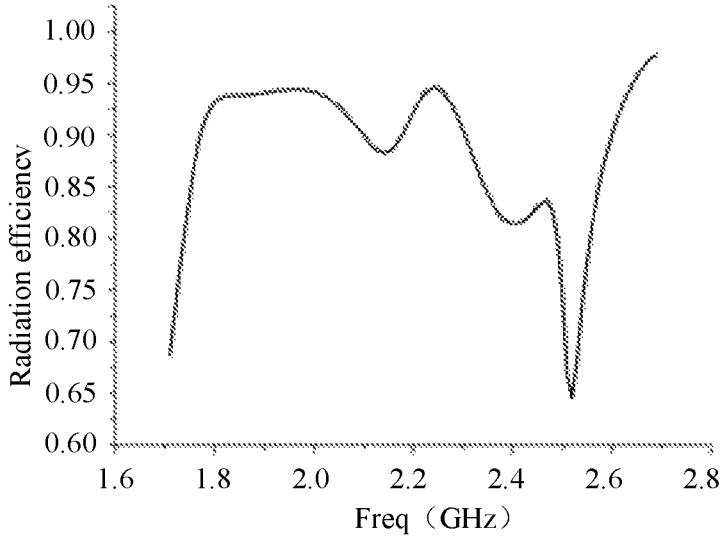
FIG. 15 is a schematic diagram for radiation efficiency of a high-frequency operation band (1710-2690 MHz) based on the embodiment shown in FIGS. 3-6.

Simulating calculation is performed for the radiation efficiency of the high-frequency band (1710-2690 MHz) based on the embodiment shown in FIGS. 3-6, the results are as shown in FIG. 15. It can be seen that the radiation efficiency of the antenna in the high-frequency band (1710-2690 MHz) is greater than 62.5%.

Figure 16:
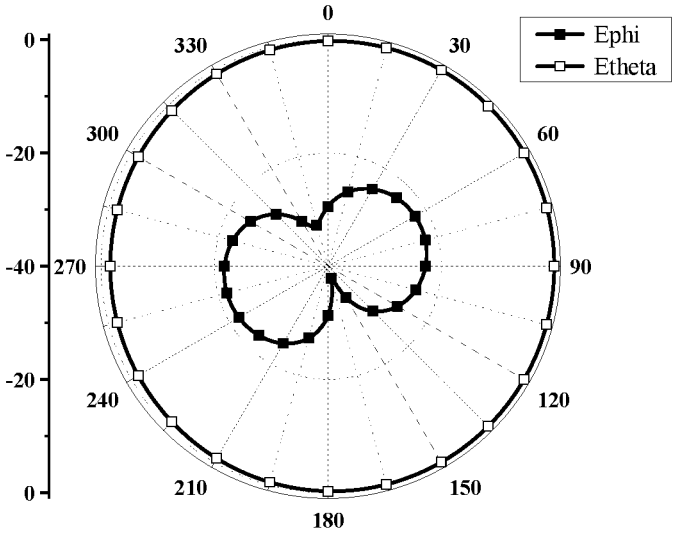
FIG. 16 is a far-field radiation pattern of a xoy-plane at 825 MHz based on the embodiment shown in FIGS. 3-6.
Figure 17:
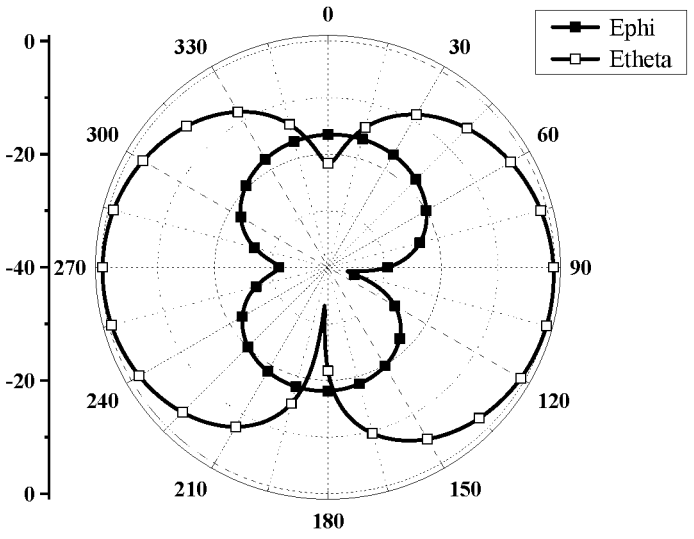
FIG. 17 is a far-field radiation pattern of a xoz-plane at 825 MHz based on the embodiment shown in FIGS. 3-6.
Figure 18:
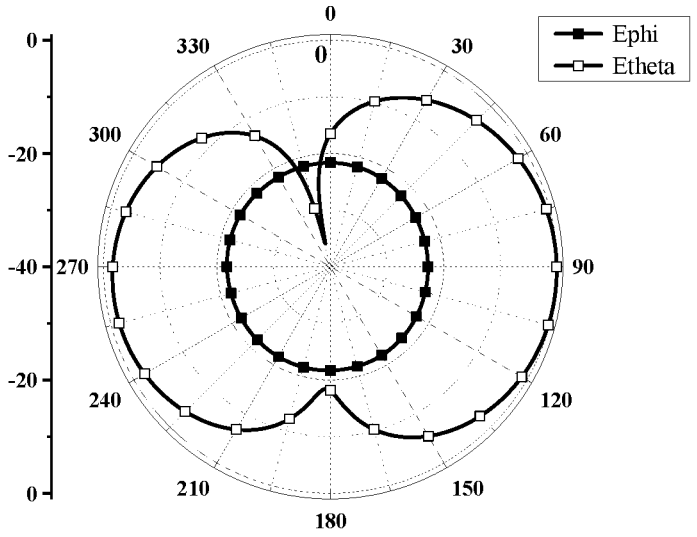
FIG. 18 is a far-field radiation pattern of a yoz-plane at 825 MHz based on the embodiment shown in FIGS. 3-6.
Figure 19:
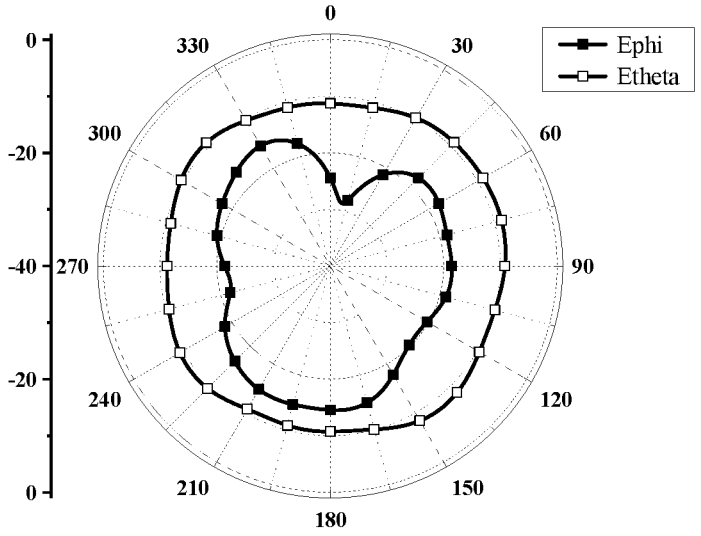
FIG. 19 is a far-field radiation pattern of a xoy-plane at 2250 MHz based on the embodiment shown in FIGS. 3-6.
Figure 20:
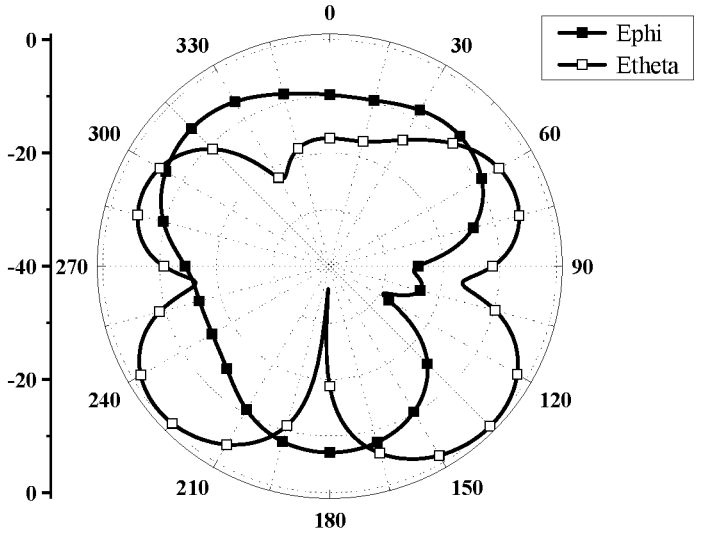
FIG. 20 is a far-field radiation pattern of a xoz-plane at 2250 MHz based on the embodiment shown in FIGS. 3-6.
Figure 21:
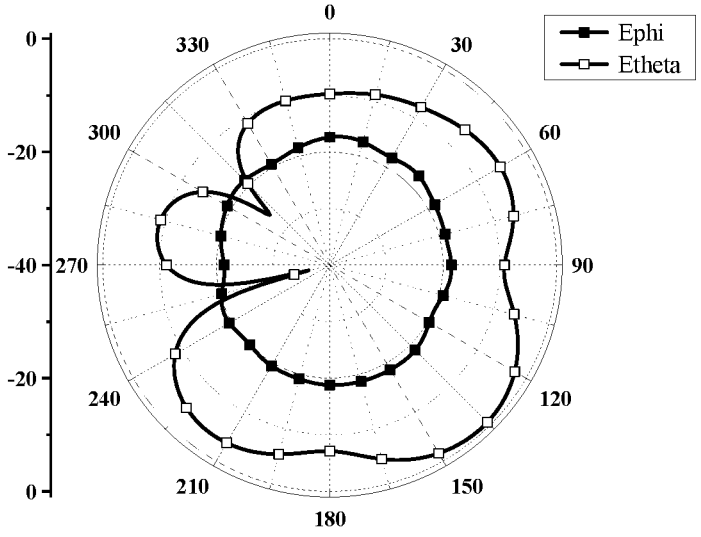
FIG. 21 is a far-field radiation pattern of a yoz-plane at 2250 MHz based on the embodiment shown in FIGS. 3-6.

Simulation is performed for the far-field radiation pattern of the xoy-plane at 825 MHz based on the embodiment shown in FIGS. 3-6, the results are as shown in FIG. 16. Simulation is performed for the far-field radiation pattern of the xoz-plane at 825 MHz based on the embodiment shown in FIGS. 3-6, the results are as shown in FIG. 17. Simulation is performed for the far-field radiation pattern of the yoz-plane at 825 MHz based on the embodiment shown in FIGS. 3-6, the results are as shown in FIG. 18. Simulation is performed for the far-field radiation pattern of the xoy-plane at 2250 MHz based on the embodiment shown in FIGS. 3-6, the results are as shown in FIG. 19. Simulation is performed for the far-field radiation pattern of the xoz-plane at 2250 MHz based on the embodiment shown in FIGS. 3-6, the results are as shown in FIG. 20. Simulation is performed for the far-field radiation pattern of the yoz-plane at 2250 MHz based on the embodiment shown in FIGS. 3-6, the results are as shown in FIG. 21. FIGS. 16-21 show the pattern of each band of the antenna, all of which indicate that the requirement on the pattern in the industry is met.

Figure 22:
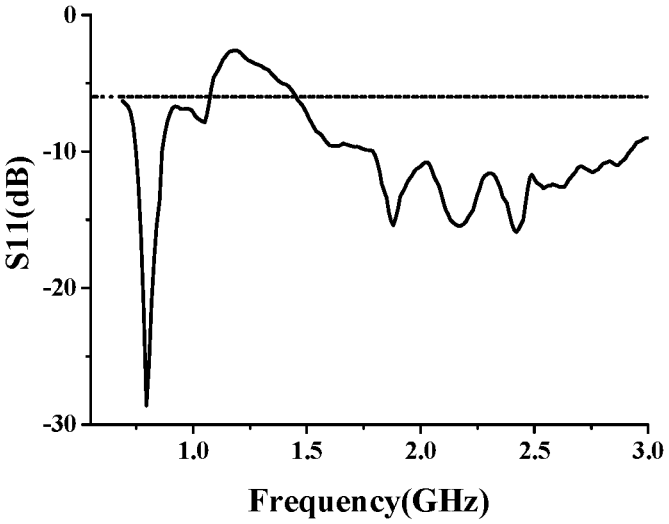
FIG. 22 is a measured diagram for an S11 parameter based on the embodiment shown in FIGS. 3-6.

The return loss of the physical model based on the embodiment shown in FIGS. 3-6 is measured by using a vector network analyzer, the results are as shown in FIG. 22. With the S11 less than −6 dB as a standard, the measured impedance widths of the antenna based on the embodiment shown in FIGS. 3-6 are 680-1100 MHz and 1480-3000 MHz. It is indicated that the antenna can cover multiple bands such as LTE700, GSM850, GSM900, DCS1800, PCS1900, UMTS, LTE2300 and LTE2600, and has a wide operation band.

Figure 23:
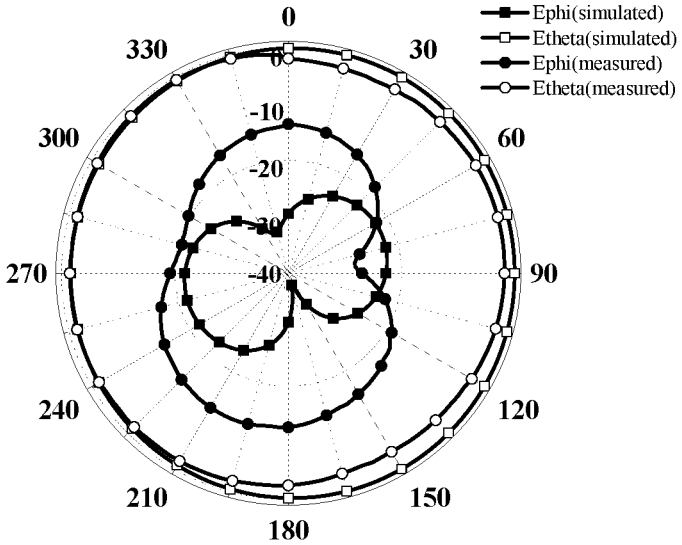
FIG. 23 is a diagram showing the comparison between measurement and simulation for a far-field radiation pattern of a xoy-plane at 825 MHz based on the embodiment shown in FIGS. 3-6.

The far-field radiation pattern of the xoy-plane at 825 MHz is measured for the physical model based on the embodiment shown in FIGS. 3-6, the results are as shown in FIG. 23. The measured far-field radiation pattern of the model based on the embodiment shown in FIGS. 3-6 has good consistency with the simulation result on the xoy-plane at 825 MHz.

Figure 24:
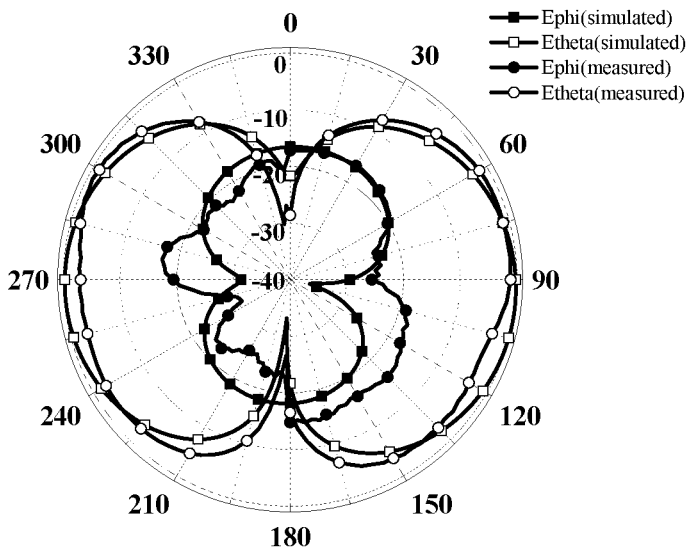
FIG. 24 is a diagram showing the comparison between measurement and simulation for a far-field radiation pattern of a xoz-plane at 825 MHz based on the embodiment shown in FIGS. 3-6.

The far-field radiation pattern of the xoz-plane at 825 MHz is measured for the physical model based on the embodiment shown in FIGS. 3-6, the results are as shown in FIG. 24. The measured far-field radiation pattern of the model based on the embodiment shown in FIGS. 3-6 has good consistency with the simulation result on the xoz-plane at 825 MHz.

Figure 25:
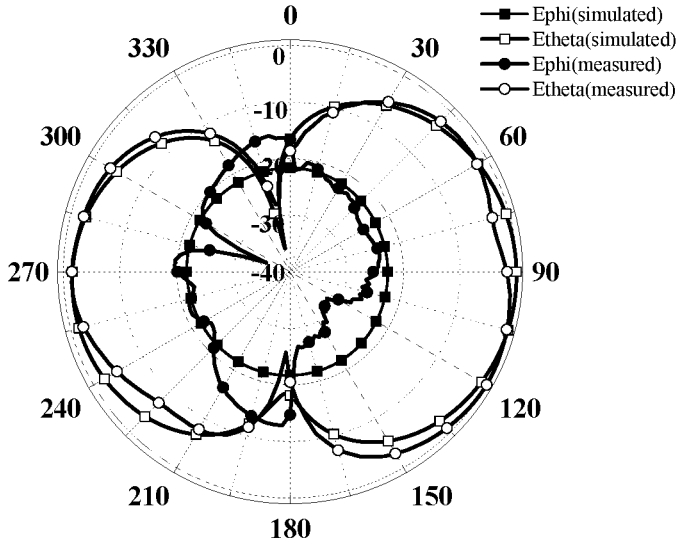
FIG. 25 is a diagram showing the comparison between measurement and simulation for a far-field radiation pattern of a yoz-plane at 825 MHz based on the embodiment shown in FIGS. 3-6.

The far-field radiation pattern of the yoz-plane at 825 MHz is measured for the physical model based on the embodiment shown in FIGS. 3-6, the results are as shown in FIG. 25. The measured far-field radiation pattern of the model based on the embodiment shown in FIGS. 3-6 has good consistency with the simulation result on the yoz-plane at 825 MHz.

Figure 26:
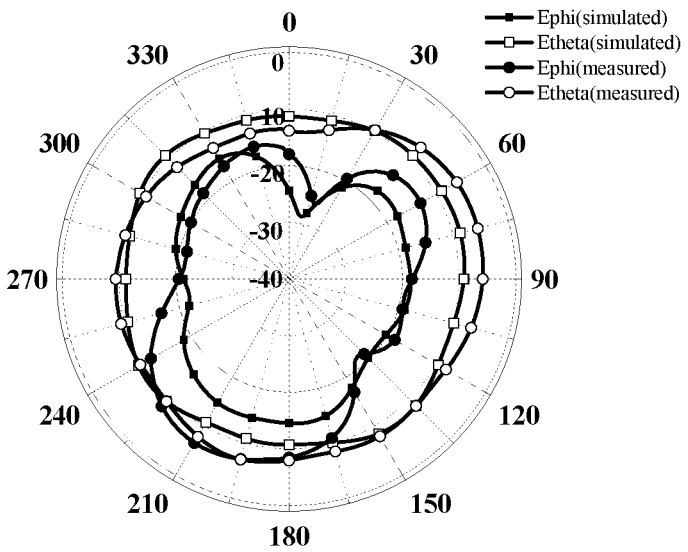
FIG. 26 is a diagram showing the comparison between measurement and simulation for a far-field radiation pattern of a xoy-plane at 2250 MHz based on the embodiment shown in FIGS. 3-6.

The far-field radiation pattern of the xoy-plane at 2250 MHz is measured for the physical model based on the embodiment shown in FIGS. 3-6, the results are as shown in FIG. 26. The measured far-field radiation pattern of the model based on the embodiment shown in FIGS. 3-6 has good consistency with the simulation result on the xoy-plane at 2250 MHz.

Figure 27:
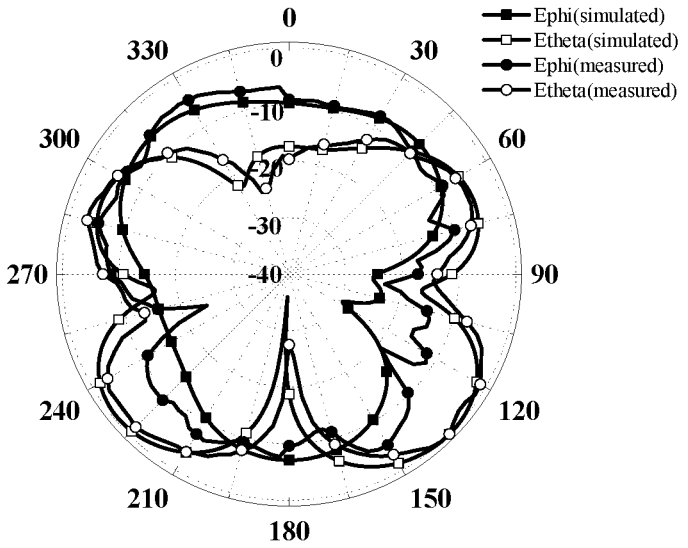
FIG. 27 is a diagram showing the comparison between measurement and simulation for a far-field radiation pattern of a xoz-plane at 2250 MHz based on the embodiment shown in FIGS. 3-6.

The far-field radiation pattern of the xoz-plane at 2250 MHz is measured for the physical model based on the embodiment shown in FIGS. 3-6, the results are as shown in FIG. 27. The measured far-field radiation pattern of the model based on the embodiment shown in FIGS. 3-6 has good consistency with the simulation result on the xoz-plane at 2250 MHz.

Figure 28:
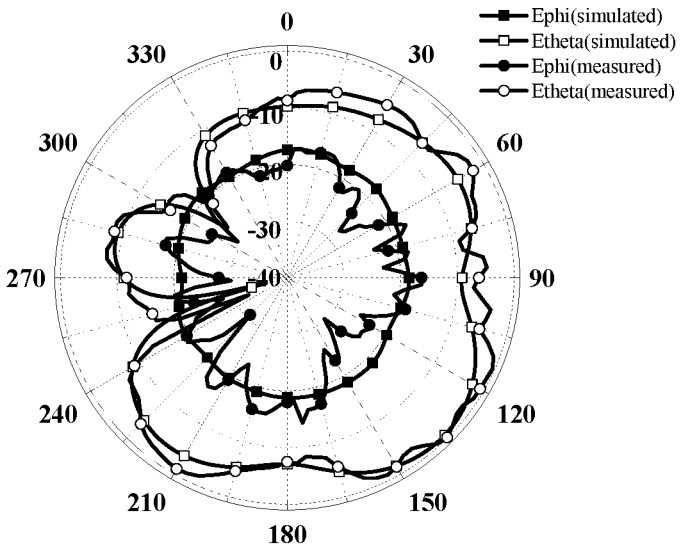
FIG. 28 is a diagram showing the comparison between measurement and simulation for a far-field radiation pattern of a yoz-plane at 2250 MHz based on the embodiment shown in FIGS. 3-6.

The far-field radiation pattern of the yoz-plane at 2250 MHz is measured for the physical model based on the embodiment shown in FIGS. 3-6, the results are as shown in FIG. 28. The measured far-field radiation pattern of the model based on the embodiment shown in FIGS. 3-6 has good consistency with the simulation result on the yoz-plane at 2250 MHz.

Figure 29:
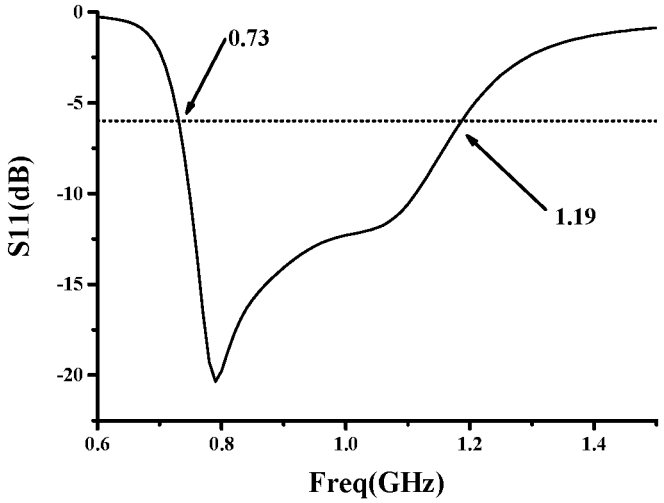
FIG. 29 is a schematic diagram for simulation on an S11 parameter of a low frequency in the embodiment in FIG. 7.

Simulating calculation is performed for the Si parameter of the low-frequency band in the embodiment in FIG. 7, the results are as shown in FIG. 29. The impedance bandwidth of the antenna in the low-frequency band is 730-1100 MHz. It is indicated that the implementation manner provided in the embodiment of the present application can also be independently used to meet the low-frequency requirement, and has a wider bandwidth than the case where the high frequency is considered.

Figure 30:
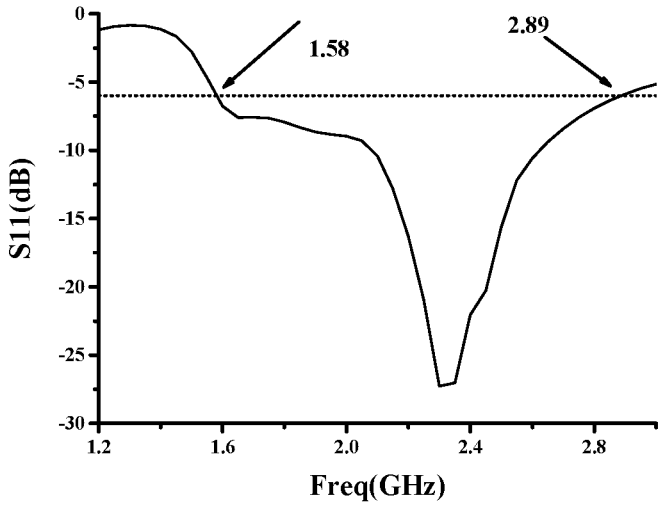
FIG. 30 is a schematic diagram for simulation on an S11 parameter of a high frequency in the embodiment in FIG. 8.

Simulating calculation is performed for the S11 parameter of the high-frequency band in the embodiment in FIG. 8, the results are as shown in FIG. 30. The impedance bandwidth of the antenna in the high-frequency band is 1580-2890 MHz. It is indicated that the implementation manner provided in the embodiment of the present application can also be independently used to meet the high-frequency requirement, and has a wider bandwidth than the case where the low frequency is considered.

Figure 31:
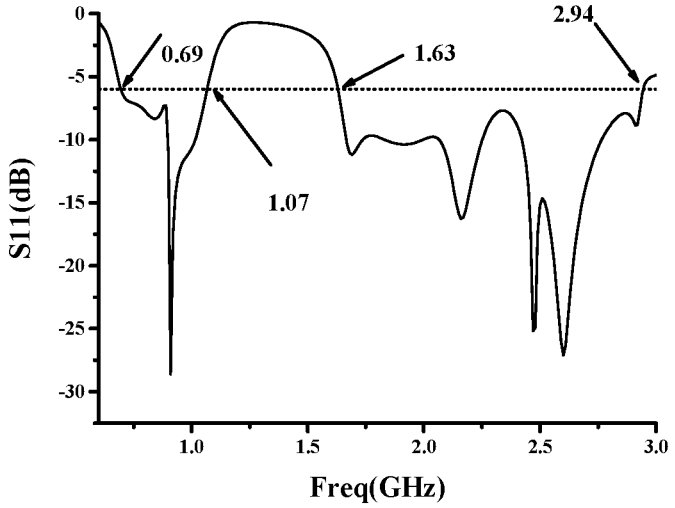
FIG. 31 is a schematic diagram for simulation on an S11 parameter in the embodiment in FIG. 9.

Simulating calculation is performed for the S11 parameter in the embodiment in FIG. 9, the results are as shown in FIG. 31. The antenna has the impedance bandwidths of 690-1070 MHz and 1630-2940 MHz. It is proved that the antenna structure in the embodiment of the present application can still keep a good operation state in a complex operation environment.

Figure 32:
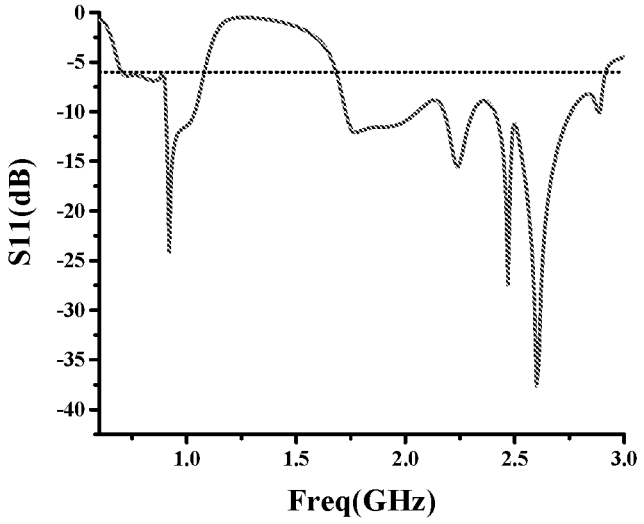
FIG. 32 is a schematic diagram for simulation on an S11 parameter in the embodiment in FIG. 10.

Simulating calculation is performed for the S11 parameter in the embodiment in FIG. 10, the results are as shown in FIG. 32. The antenna has the impedance bandwidths of 698-1080 MHz and 1680-2920 MHz. It is proved that the antenna is diverse in implementation form in the embodiment of the present application, the implementation form is not limited to the rectangular shape, and other forms such as the elliptical shape may also achieve the good operation state.

The above embodiments merely illustrate some examples of the antenna. In case of a change in dimensions or material of the ground plate, the antenna can still operate by adjusting the antenna unit. That is, the technical solutions in the embodiments of the present application can be applied to different operation environments to construct the antenna of the mobile terminal based on the CRLH-TL. In addition, the patch structure in the embodiment is not limited to regular geometrical shapes such as the rectangular shape and the circular shape.

The Inductor-Resistor (LR), LR, Capacitor-Inductor (CL) and LR are also not limited to the rectangular shape.

To sum up, through the form of the CRLH-TL in the embodiment of the present application, the resonance unit having the high-frequency broadband is implemented under the premise of ensuring the low-frequency operation characteristic. With the utilization of the CRLH-TL technology, the resonance unit having the low-frequency broadband is designed.

By adding one segment of traditional rectangular monopole structure, the antenna improves the impedance bandwidth of the high-frequency band and thus can cover the high-frequency operation band. The two structures jointly form the resonance units capable of covering multiple bands such as LTE700/GSM850/GSM900 DCS1800/PCS1900/UMTS/LTE2300/LTE2600.

The embodiments of the present application also provide a mobile terminal, which may include the above antenna of the mobile terminal.

The mobile terminal may be implemented in various forms. For example, the mobile terminal described in the embodiment of the present application may include mobile terminals such as a mobile phone, a smartphone, a laptop, a digital broadcast receiver, a Personal Digital Assistant (PDA), a PAD, a Portable Media Player (PMP) and a navigation device.

However, it is to be understood by a person skilled in the art that except for components for special purposes, structures according to the implementation modes of the present application can also be applied to fixed types of terminals, and fixed terminals such as a digital Television (TV), and a desktop.

Although the implementation modes disclosed in the present application are as described above, the contents are merely the implementation modes used for the ease of understanding on the present application and are not intended to limit the present application. Any person having ordinary skill in the art to which the present application belongs may make modifications and changes in implementation form and details without departing from the principle of the present application. However, the scope of protection of the present application is still subjected to the scope defined by the appended claims.

What is claimed is:

1. An antenna of a mobile terminal, comprising a dielectric substrate, a ground plate located on one side of the dielectric substrate, and a near-feed unit, a near-ground unit and a coupling unit that are arranged on the other side of the dielectric substrate, wherein one end of the near-ground unit is connected to the coupling unit, and the other end of the near-ground unit is connected to the ground plate; the coupling unit and the near-ground unit are equivalent to a Left-Handed (LH) inductor; the near-feed unit is equivalent to a Right-Handed (RH) inductor; the coupling unit is coupled to the near-feed unit and is equivalent to an LH capacitor; the coupling unit is coupled to the ground plate and is equivalent to an RH capacitor; and the near-feed unit, the near-ground unit, the coupling unit and the ground plate form a Composite Right-Left-Handed Transmission Line (CRLH-TL) structure;

wherein the near-feed unit comprises an annular portion and a feed line that are connected, and one end of the feed line is connected to the annular portion, and the other end of the feed line is connected to a feed point.

2. The antenna of the mobile terminal as claimed in claim 1, wherein a gap is formed between the coupling unit and the near-feed unit.

3. The antenna of the mobile terminal as claimed in claim 1, wherein the coupling unit comprises either or both of a low-frequency resonance unit and a high-frequency resonance unit.

4. The antenna of the mobile terminal as claimed in claim 3, wherein the low-frequency resonance unit comprises a first branch and a second branch, the first branch is of a U-shaped structure, the second branch is of a foldline structure, and the first branch is connected to the second branch through the near-ground unit.

5. The antenna of the mobile terminal as claimed in claim 4, wherein the first branch comprises a first segment, a second segment and a third segment that are sequentially connected, the first segment is connected to the near-ground unit, and is located on a surface of the dielectric substrate, the second segment is perpendicular to the dielectric substrate, the third segment is away from the dielectric substrate, and is located above the first segment, and a part of a plane of the third segment is perpendicular to the dielectric substrate, and other part of the plane of the third segment is parallel to the dielectric substrate.

6. The antenna of the mobile terminal as claimed in claim 4, wherein the second branch comprises a fourth segment, a fifth segment and a sixth segment that are sequentially connected, the fourth segment is connected to the near-ground unit, and is located on the surface of the dielectric substrate, the fifth segment is perpendicular to the dielectric substrate, the sixth segment is away from the dielectric substrate, and extends in a direction away from the fourth segment, and a part of a plane of the sixth segment is perpendicular to the dielectric substrate, and other part of the plane of the sixth segment is parallel to the dielectric substrate.

7. The antenna of the mobile terminal as claimed in claim 3, wherein the high-frequency resonance unit comprises a first patch, and the first patch is perpendicular to the dielectric substrate.

8. The antenna of the mobile terminal as claimed in claim 7, wherein the first patch is of a rectangular shape, and is located in a U-shape of a first branch in the low-frequency resonance unit.

9. The antenna of the mobile terminal as claimed in claim 7, wherein the high-frequency resonance unit further comprises a second patch, and the second patch is perpendicular to the dielectric substrate.

10. The antenna of the mobile terminal as claimed in claim 9, wherein the second patch is of a rectangular shape, and is located between fifth and sixth segments in a second branch of the low-frequency resonance unit and the dielectric substrate.

11. The antenna of the mobile terminal as claimed in claim 1, wherein the annular portion is parallel to the dielectric substrate, and is of a rectangular shape or an elliptical shape; and the feed line is of an L-shaped structure or a linear structure.

12. The antenna of the mobile terminal as claimed in claim 1, wherein the coupling unit comprises a first planar portion and a second planar portion that are connected, the first planar portion is perpendicular to the dielectric substrate, and the second planar portion is parallel to the dielectric substrate.

13. The antenna of the mobile terminal as claimed in claim 12, wherein the near-feed unit comprises a patch portion and a feed line that are connected, one end of the feed line is connected to the patch portion, and the other end of the feed line is connected to a feed point, and a gap is formed between the patch portion and the second planar portion.

14. The antenna of the mobile terminal as claimed in claim 13, wherein the patch portion is of a rectangular shape, is parallel to the dielectric substrate, and is located on the same plane with the second planar portion.

15. The antenna of the mobile terminal as claimed in claim 1, wherein the near-ground unit is a short-circuited line.

16. A mobile terminal, comprising an antenna of the mobile terminal, wherein the antenna of the mobile terminal comprises a dielectric substrate, a ground plate located on one side of the dielectric substrate, and a near-feed unit, a near-ground unit and a coupling unit that are arranged on the other side of the dielectric substrate, wherein one end of the near-ground unit is connected to the coupling unit, and the other end of the near-ground unit is connected to the ground plate; the coupling unit and the near-ground unit are equivalent to a Left-Handed (LH) inductor; the near-feed unit is equivalent to a Right-Handed (RH) inductor; the coupling unit is coupled to the near-feed unit and is equivalent to an LH capacitor; the coupling unit is coupled to the ground plate and is equivalent to an RH capacitor; and the near-feed unit, the near-ground unit, the coupling unit and the ground plate form a Composite Right-Left-Handed Transmission Line (CRLH-TL) structure;

wherein the near-feed unit comprises an annular portion and a feed line that are connected, and one end of the feed line is connected to the annular portion, and the other end of the feed line is connected to a feed point.

17. The mobile terminal as claimed in claim 16, wherein a gap is formed between the coupling unit and the near-feed unit.

18. The mobile terminal as claimed in claim 16, wherein the coupling unit comprises either or both of a low-frequency resonance unit and a high-frequency resonance unit.

* * * * *